US010351388B2

(12) United States Patent
Ascua et al.

(10) Patent No.: US 10,351,388 B2
(45) Date of Patent: Jul. 16, 2019

(54) PNEUMATIC VACUUM ELEVATOR CABIN GUIDES

(71) Applicants: Carlos M. Ascua, Parana (AR); Juan Carlos de Ledebur, Miami, FL (US)

(72) Inventors: Carlos M. Ascua, Parana (AR); Juan Carlos de Ledebur, Miami, FL (US)

( * ) Notice: Subject to any disclaimer, the term of this patent is extended or adjusted under 35 U.S.C. 154(b) by 0 days.

(21) Appl. No.: 15/729,705

(22) Filed: Oct. 11, 2017

(65) Prior Publication Data

US 2019/0106293 A1 Apr. 11, 2019

(51) Int. Cl.
*B66B 7/04* (2006.01)
*B66B 9/04* (2006.01)

(52) U.S. Cl.
CPC ..... *B66B 7/047* (2013.01); *B66B 9/04* (2013.01)

(58) Field of Classification Search
CPC ..... B66B 7/04; B66B 7/047; B66B 7/048; B66B 9/04
See application file for complete search history.

(56) References Cited

U.S. PATENT DOCUMENTS 248,150 A * 10/1881 Ellithorpe ..... B66B 9/04 187/347
2,498,299 A * 2/1950 Rissler ..... B66B 7/046 187/406
5,583,326 A * 12/1996 Sors ..... B66B 9/04 182/48
6,085,873 A * 7/2000 Macchi ..... B66B 9/04 187/273
6,345,698 B1 * 2/2002 Ravishankar ..... B66B 7/046 187/409
6,698,138 B1 * 3/2004 Lin ..... E05D 15/0639 16/105
8,251,186 B2 * 8/2012 Webster ..... B66B 7/04 187/401
9,845,155 B2 * 12/2017 Brown ..... B64D 9/00
2006/0175151 A1 * 8/2006 Perez ..... B66B 7/046 187/410
2008/0017457 A1 * 1/2008 Ach ..... B66B 7/047 187/409
2010/0065382 A1 * 3/2010 Beaudry ..... B66B 7/048 187/409
2013/0098714 A1 * 4/2013 Kocher ..... B66B 7/047 187/409
2015/0291396 A1 * 10/2015 Nakamura ..... B66B 17/12 187/404

* cited by examiner

*Primary Examiner* — Minh Truong
(74) *Attorney, Agent, or Firm* — Patent CEO, LLC; Phillip Vales

(57) ABSTRACT

A first adjustable cabin rail guide is moveably attached to a structural member of an elevator cabin. A second adjustable cabin rail guide is similarly moveably attached to a structural member of an elevator cabin. The first and second adjustable cabin rail guides cooperate together to reduce sound and increase operational efficiency. A piece of textile or similar material is attached to a tube forming the friction portion of the guide. The use of textile thereby reduces the sound of the travel upon the rail associated with the inner portion of the elevator cylinder as the cabin transits therein.

12 Claims, 6 Drawing Sheets

PNEUMATIC VACUUM ELEVATOR CABIN GUIDES

FIELD OF THE INVENTION

The present invention relates to a Pneumatic Vacuum Elevator; more particularly, the present invention relates to devices that stabilize and regulate the path of a car or cabin within a pneumatic vacuum elevator cylinder.

BACKGROUND OF THE INVENTION

Elevators typically use countervailing weights in order to facilitate a passenger cabin moving up and down an elevator shaft in large office buildings, hospitals, factories and similar structures. These types of elevators require a great deal of space, maintenance, equipment and machinery. More recently, a new type of elevator has been developed known as a vacuum elevator system. This elevator uses air pressure to cause the motion of the cabin within a thoroughfare or tubular cylinder that uses the air within it as a working fluid upon the confines of the cabin. Brakes, motors, valves, electronic controls and other equipment work in concert to ensure a safe and pleasant riding experience for each occupant therein.

Modern cabins have an integral carriage that is utilized to stabilize it within the confines of the elevator cylinder. Typically, there are several wheels attached to the carriage. These wheels are associated with or otherwise ride upon a cylinder guide rail integral with the cylinder. However, several problems have arisen with respect to the current state of the art. First, the wheels are hard to adjust making initial setup problematic and time consuming; additionally, due to the aforementioned, routine maintenance is likewise difficult in existing installations. Secondly, the wheels are heavy to port to a job site, to operate as they expend more electrically and to dispose of because of their weight. Finally, the wheels make a great deal of noise and vibration thereby reducing the ride quality therein.

Accordingly, there needs to be some solutions to overcome the aforementioned problems.

SUMMARY OF THE INVENTION

The present invention overcomes the deficiencies of the known art and the problems that remain unsolved by providing as described herein and in the accompanying drawings.

A pneumatic vacuum elevator guide system comprising:

a pneumatic vacuum elevator cabin having
a support member attached thereto; and a first rail guide moveably mounted with respect to the pneumatic vacuum elevator cabin on the support member; wherein the first rail guide further comprises:

a tube having a first external surface;

a first textile material attached to the first external surface of the tube such that the tube directly impacts a first rail through the first textile material; wherein the first rail is attached to a pneumatic vacuum elevator thoroughfare within which the pneumatic vacuum elevator cabin moves;

a sheet movably attached to the support member and such that the tube is movably attached to the sheet; wherein the movable attachment of the sheet to the support member has a different degree of motion relative the pneumatic vacuum elevator cabin compared to the movable attachment of the tube to the sheet;

a friction adjuster attaching the sheet to the tube whereby the movable attachment of the tube to the sheet allows for a variable selective friction force to the first rail through the first textile material;

wherein the friction adjuster further comprises:

an adjustable spring assembly;

a fastener inserted within a hole in the sheet and attached therethrough to the threaded rivet which is attached to a hole in the tube; and having a spring between the threaded rivet and the fastener such that the fastener passes through spring allowing for selective variable friction force applied to the first rail through the first textile material.

In another aspect, further comprises:

a second rail guide moveably mounted with respect to the pneumatic vacuum elevator cabin; wherein the second rail guide further comprises:

a second tube having a second external surface;

a second textile material attached to the external surface of the second tube such that the second tube directly impacts the first rail through the second textile material.

In another aspect, wherein the sheet further comprises:

a rigid material moveably attached to the support member.

In another aspect, further comprising:

an intergral first flange at an end of the moveably attaching the sheet to the pneumatic vacuum elevator cabin through the support member.

In another aspect, further comprising:

an integral first flange at an end of the sheet moveably attaching the sheet to the pneumatic vacuum elevator cabin through the support member such that the first flange and the second flange are disposed at opposite ends of the sheet.

An elevator rail guide assembly comprising:

a first rail guide moveably attached to
an elevator cabin; wherein the first rail guide comprises a textile material fixedly attached to an external surface of a textile mount wherein the textile mount is formed as a tube;

whereby the tube directly impacts a rail within an elevator thoroughfare through the textile material;

a support member integral with the elevator cabin whereby the first rail guide further comprises a sheet that is movably attached to the support member;

whereby the tube is movably attached to the sheet; and wherein the moveable attachment of the sheet with respect to the support member has distinct degrees of motion relative to the elevator cabin compared to the moveable attachment of the tube with respect to the sheet;

wherein the attachment of the tube to the sheet is through a friction adjuster having selective variable friction force applied to the rail;

wherein the friction adjuster further comprises a fastener adjustably attached to the threaded rivet between the tube and the sheet using a spring; whereby the tube is movably attached to the sheet through an adjustment of the fastener thereby providing selective variable friction force to the rail.

In another aspect, wherein:

the fastener and the threaded rivet are attached together between the rigid members and the tube through a hole in the rigid member and a corresponding hole in the tube with the spring loaded therebetween.

In another aspect, wherein:

the sheet is a rigid member moveably attached to the elevator cabin and directly attached to the friction rail tightening adjuster such that the rigid member is movably attached to the tube through the friction adjuster.

In another aspect, wherein:

the sheet comprising a rigid member having a flange such that the rigid member is thereby movably attached to the elevator cabin.

A pneumatic vacuum elevator system comprising:

a pneumatic vacuum elevator cylinder having a cabin inserted therein;

a first adjustable rail guide comprising:

a rigid member moveably attached to the cabin;

a tube that has a textile material attached thereto, such that the tube is adjustably attached with respect to the rigid member using a friction adjuster attached to the rigid member and to the tube; the friction adjuster has selective variable friction applied to a rail;

the first adjustable rail guide is moveably attached with respect to the cabin and in physical contact with the rail attached to the pneumatic vacuum elevator cylinder such that the tube directly contacts the rail through the textile material;

wherein the adjustable attachment of the tube to the rigid member has different degree of motion relative to the cabin compared to the moveable attachment of the rigid member to the cabin; and wherein the friction adjuster further comprises a fastener and a threaded rivet attached together between the rigid member and the textile material mount through a hole in the rigid member and a corresponding hole in the textile material mount with a spring loaded therebetween.

In another aspect, wherein the rigid member further comprises:

a sheet having an integral flange movably attached to the cabin using the flange.

In another aspect, wherein:

the textile material mounted on an external surface of the tube directly contacts the rail.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
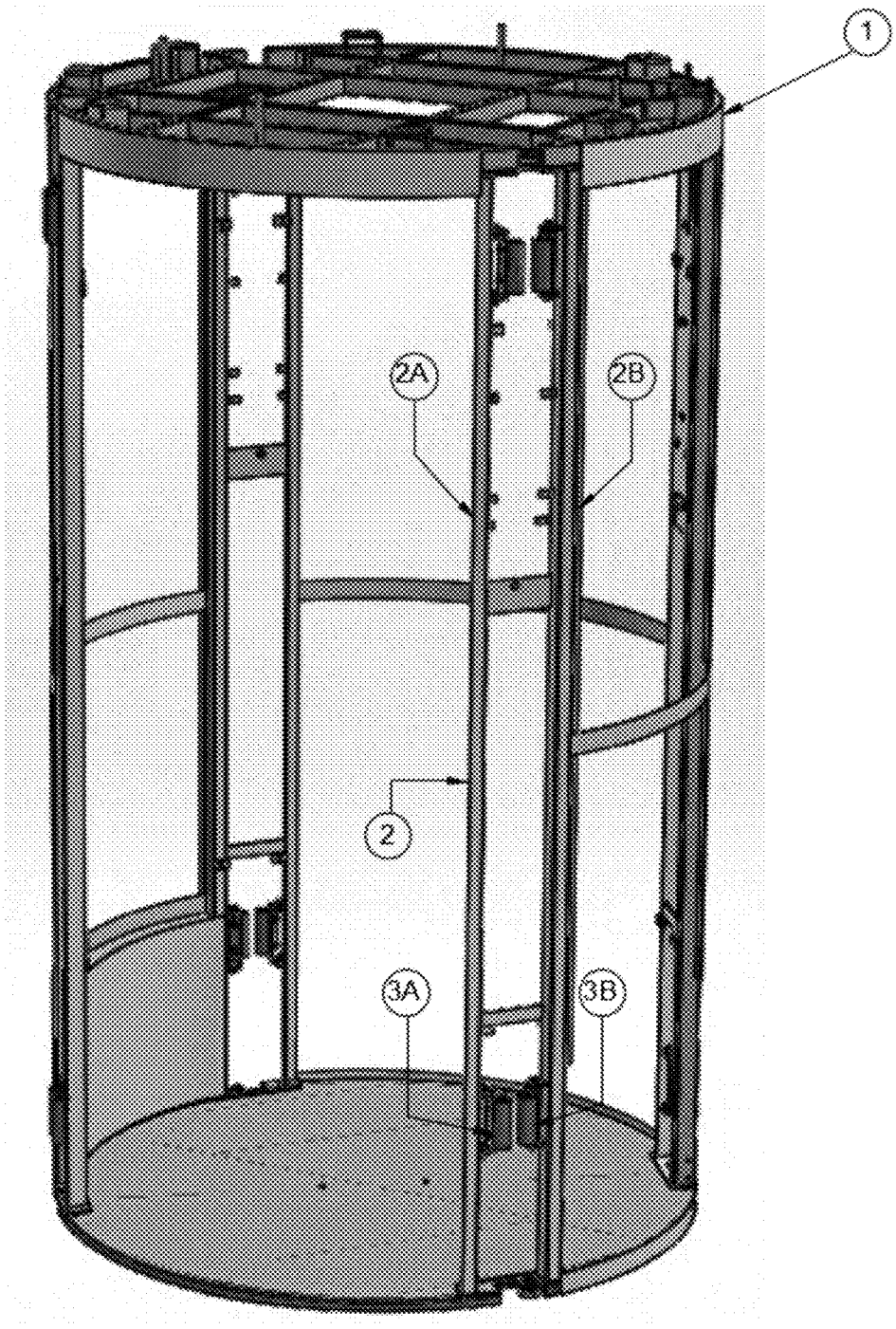
FIG. 1A presents a front view of a cabin having the novel guides associated therewith as taught in an embodiment disclosed herein.

FIG. 1A presents a front view of a cabin 1 having the novel guides associate therewith as taught in an embodiment disclosed herein. The cabin has four vertical dual support members 2 integrally attached thereto for a total of eight members 2A, 2B. These dual support members 2 each have two pairs of guides 3 disposed there between for a total of eight pairs of guides or sixteen individual guides 3A, 3B mounted on a cabin. As an example, a first member 2A has a first guide 3A associated therewith and there is an opposing second guide 3B attached to the second member 2B; a second pair of guides is likewise attached between the first and second member further down the dual support members 2. Thus, it should be understood that each pair of first and second guides cooperate to engage a cylinder rail and thereby provide travel stabilization to the cabin as it translates up and down within the elevator cylinder.

Figure 1B:
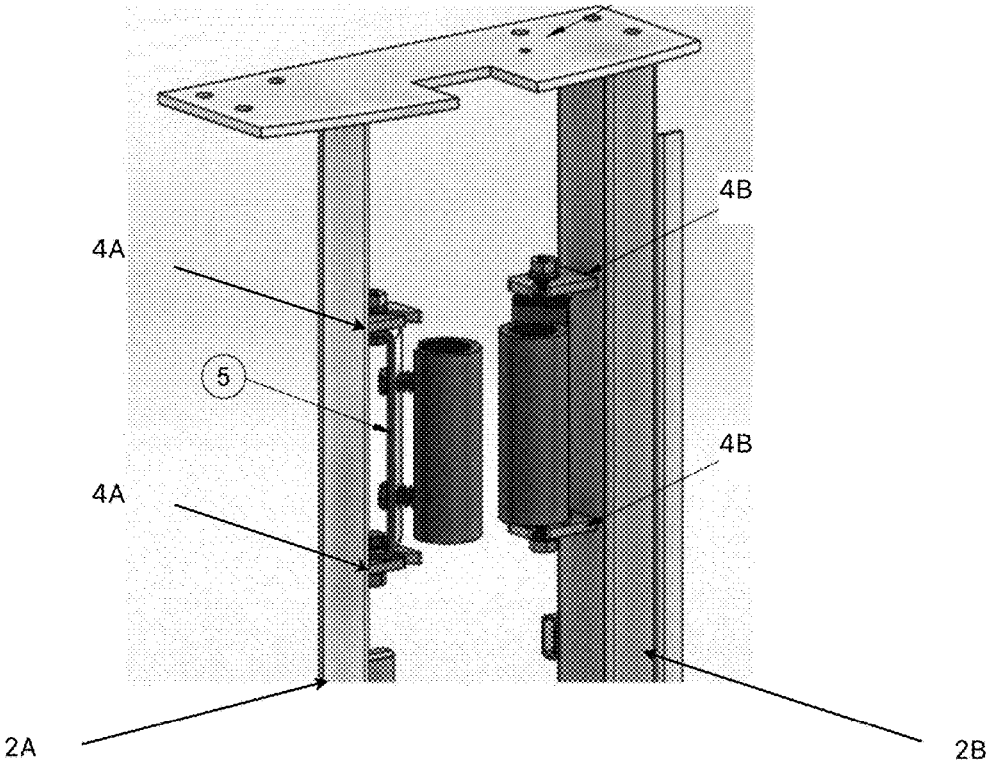
FIG. 1B presents a closeup front view of the novel guides mounted in a cabin as taught in an embodiment disclosed herein.

FIG. 1B presents a closeup front view of the novel guides as taught in an embodiment disclosed herein. A first member 2A has a first pair 4A of integral horizontal protrusions (having a hole in each protrusion) parallel to each other that extend towards the opposing second member 2B that likewise has a second pair 4B of integral horizontal protrusions (having a hole in each protrusion) parallel to each other and extending towards the first pair. The first pair 4A of horizontal protrusions (along with fasteners) is used to mount a first guide using flanges 5A, 5B at the posterior and anterior portions of a flanged iron sheet 5 forming a part of the first guide as described below.

Similarly, the second pair 4B of horizontal protrusions (along with fasteners) is used to mount a second guide using flanges 5A, 5B at the posterior and anterior portions of another flanged iron sheet 5 forming a part of the second guide as described below. Since there is another guide pair on the dual support member 3 there is also a third pair of horizontal protrusions (having a hole in each protrusion) on the first member and a fourth pair of horizontal protrusions (having a hole in each protrusion) on the second member. These are similarly used to mount corresponding guides there between. It should be finally appreciated that the guides are adjusted at 45 degree angle to a cabin 1 tangent so as to impact a cylinder rail thereby guiding the motion of the cabin 1 in the cylinder.

Figure 2:
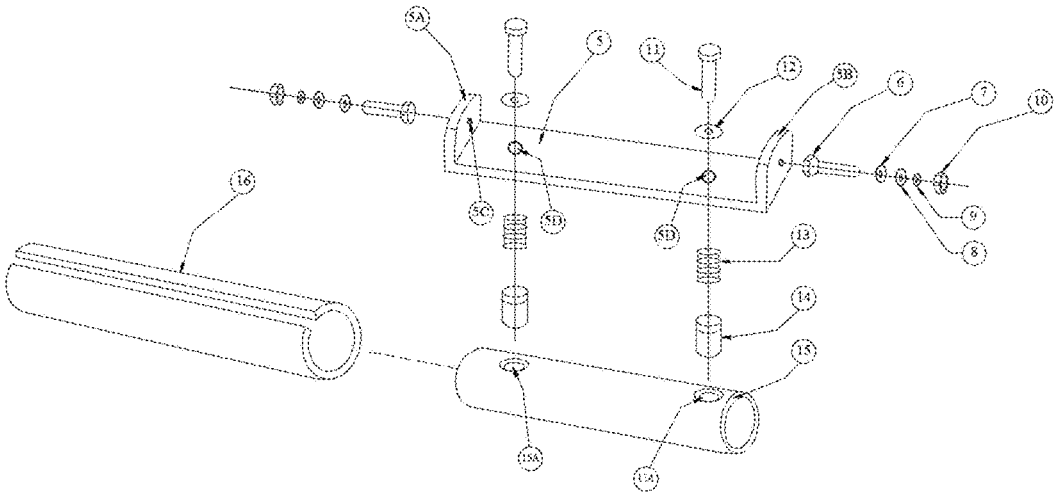
FIG. 2 presents a disassembled view of the various components found in the guides as taught in an embodiment disclosed herein.

FIG. 2 presents a disassembled view of the various components found in the guides as taught in an embodiment disclosed herein. This exemplary implementation of the guide has various components: a dual flanged (5A, 5B) iron sheet 5, a pair of hexagonal head bolts 6, a first pair of flat washers 7, a second pair of flat washers 8, a pair of pressure washers 9, a pair of hex nuts 10, a pair of machined bolts , a pair of flat washers 12, a pair of springs 13, a pair of threaded rivets 14, a tube 15 (SAE 1010) and a carpet strip 16 or boucle.

The dual flanged iron sheet 5 is used to mount each guide to its corresponding structural member 2A, 2B horizontal protrusions as described in FIG. 1A. That is, the flanges 5A, 5B are each aligned next to a horizontal protrusion 4A on member 2A or 4B on member 2B of FIG. 1B so that the longitudinal portion of iron sheet 5 is disposed vertically and the flanges 5A, 5B are horizontally disposed. In this fashion, the iron sheet 5 and flanges 5A, 5B are positioned within the horizontal pair of protrusions 4A or 4B of the corresponding member which it is to be attached to. Each flange 5A, 5B has a hole 5C therein that matches a corresponding hole in a horizontal protrusion for attachment thereto.

In order to attach the iron sheet to the horizontal protrusions, one first takes a hexagonal bolt 6 and inserts this into a flat washer 7 and then within flange 5A hole 5C and on into a hole in the appropriate horizontal protrusion 4A, 4B of the appropriate member then on into a second flat washer 8. Next, the hexagonal bolt 6 is inserted within pressure washer 9 and it is secured to the horizontal protrusion 4A, 4B of the appropriate member with a hex nut 10. It should be appreciated that the other flange 5B is similarly connected to an appropriate horizontal protrusion to cause the iron sheet 5 to thereby be attached to a member 2A, 2B.

The dual flanged iron sheet 5 also has a pair 5D of holes in its longitudinal portion. These 5D holes are used to attach a tube 15 to the dual flanged iron sheet 5 thereby facilitating the final attachment of a piece of carpet 16 used as a slide and sound suppressor. The tube 15 is attached to the dual flanged iron sheet 5 using the following components a pair of machined bolts 11, a pair of flat washers 12, a pair of springs 13, a pair of threaded rivets 14. Each machined bolt 11 is first placed within a flat washer 12 and on into a hole 5D in the longitudinal portion of the dual flanged iron sheet 5. The machined bolt 11 exits out therefrom and passes into a spring 13 and into an internally threaded rivet 14 that permits the adjustment of the amount (by turning of the bolt 11) of friction force that is applied to a elevator cylinder rail impacted by the carpet 16.

The rivet 14 is inserted within one of two corresponding holes 15A in a metal tube 15 and attached appropriately thereto. The other machined bolt 11 uses the other corresponding components as described previously and the attachment proceeds accordingly. Finally, a strip of material such as a carpet boucle 16 is attached using glues, adhesives or similar modalities to the external portion about the tube 15 thereby facilitating the quiet and smooth operation of the pair of guides as they slide upon the rail of the elevator cylinder. It should be appreciated that numerous types of textile materials are suitable for this purpose.

Figure 3:
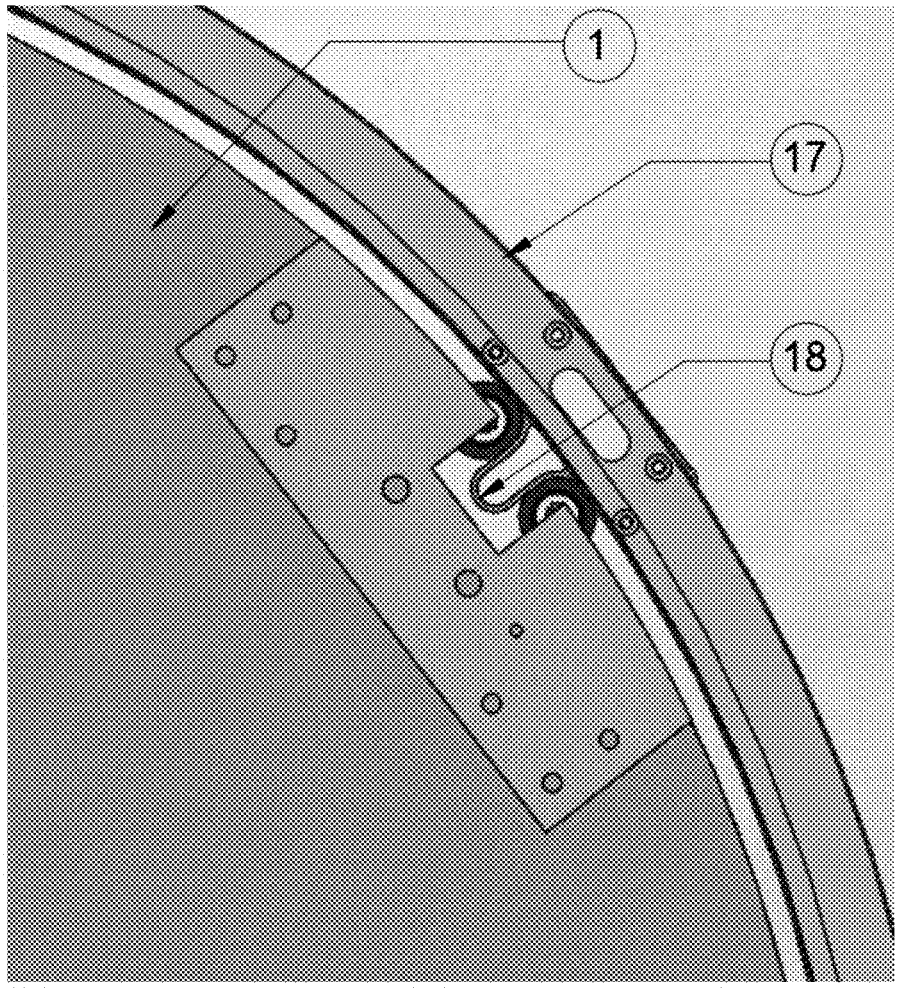
FIG. 3 presents a top view of the cabin mounted within a cylinder having the guides appropriately adjusted and mounted in frictional contact with a cylinder rail as taught in an embodiment disclosed herein.

FIG. 3 presents a top view of the cabin 1 mounted within a cylinder 17 having the guides appropriately adjusted and mounted in frictional contact with an internal cylinder rail 18 as taught in an embodiment disclosed herein.

Figure 4:
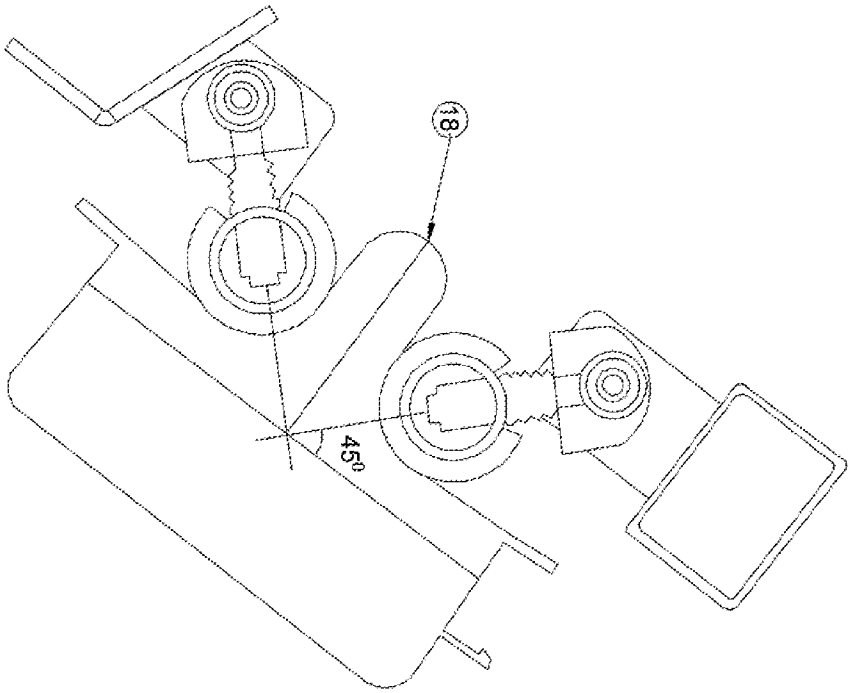
FIG. 4 presents a top view of the guides frictionally associated with the cylinder rail as taught in an embodiment disclosed herein.

FIG. 4 presents a top view of the guides frictionally associated with the cylinder rail 18 as taught in an embodiment disclosed herein. It should be appreciated that the guides are adjusted optimally at 45 degree angle to a cabin 1 tangent so as to impact a cylinder rail thereby guiding the motion of the cabin 1 in the cylinder; of course, other angles are possible depending on the implementation.

Figure 5:
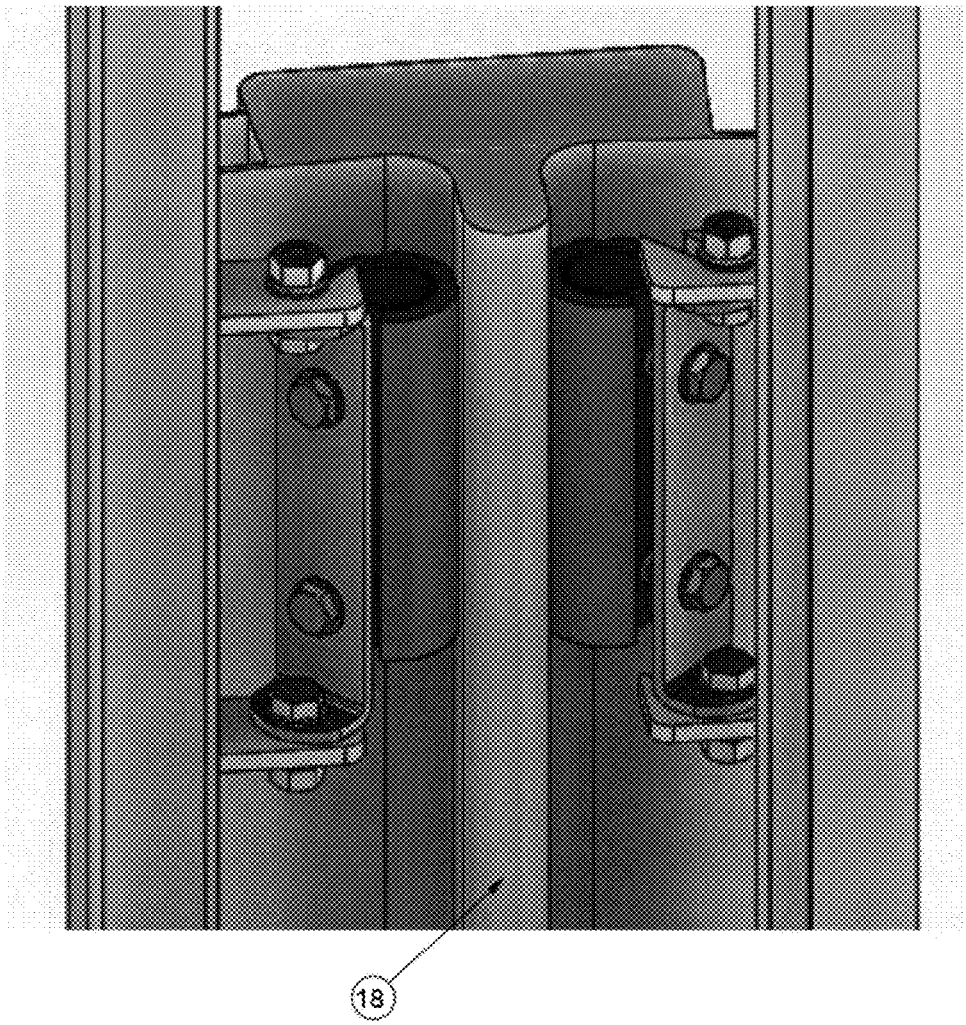
FIG. 5 presents a closeup internal cylinder view showing the guides frictionally associated with the cylinder rail as taught in an embodiment disclosed herein.

FIG. 5 presents a closeup internal cylinder view from a perspective inside the cabin 1 showing the guides frictionally associated with the cylinder rail 18 as taught in an embodiment disclosed herein.

The process of aligning the car with respect to the cylinder is performed as follows:

1. Center the cabin with respect to the elevator cylinder, matching the center of each column fixing plate with a center of the elevator cylinder rail (omega).

2. Ensure concentricity between the cabin and the elevator cylinder over the entire circumference.

3. Position the guide on the elevator cylinder rail by giving it the position angle of approximately 45° with respect to the horizontal protrusions on each vertical member of the cabin and then let the spring rest on the column rail as shown in FIG. 4.

Thus, a guide has been described that drastically reduces cabin vibration within the elevator cylinder as it translates upwards and downwards therein. Also, the guides are silent or almost completely silent and unnoticeable to the cabin occupants thereby improving user experience. Next, the guides are adjustable thereby absorbing small mismatches in the coupling between the elevator cylinder and the cabin. Additionally, because of the materials used they are lightweight and are simple to operate and easy to replace. Finally, the guides are accessible from the cabin interior and are removable for replacement or adjustment as necessary.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A pneumatic vacuum elevator guide system comprising:

a pneumatic vacuum elevator cabin having a support member attached thereto; and a first rail guide moveably mounted with respect to the pneumatic vacuum elevator cabin on the support member; wherein the first rail guide further comprises:

a tube having a first external surface;

a first textile material attached to the first external surface of the tube such that the tube directly impacts a first rail through the first textile material; wherein the first rail is attached to a pneumatic vacuum elevator thoroughfare within which the pneumatic vacuum elevator cabin moves;

a sheet movably attached to the support member and such that the tube is movably attached to the sheet; wherein the movable attachment of the sheet to the support member has a different degree of motion relative to the pneumatic vacuum elevator cabin compared to the movable attachment of the tube to the sheet;

a friction adjuster attaching the sheet to the tube whereby the movable attachment of the tube to the sheet allows for a variable selective friction force to the rail through the first textile material;

wherein the friction adjuster further comprises:

an adjustable spring assembly;

a fastener inserted within a hole in the sheet and attached therethrough to a threaded rivet which is attached to a hole in the tube; and having a spring between the threaded rivet and the fastener such that the fastener passes through spring allowing for selective variable friction force applied to the first rail through the first textile material.

2. The pneumatic vacuum elevator guide system of claim 1, further comprising:

a second rail guide moveably mounted with respect to the pneumatic vacuum elevator cabin; wherein the second rail guide further comprises:

a second tube having a second external surface;

a second textile material attached to the external surface of the second tube such that the second tube directly impacts the first rail through the second textile material.

3. The pneumatic vacuum elevator guide system of claim 1, wherein the sheet further comprises:

a rigid material moveably attached to the support member.

4. The pneumatic vacuum elevator guide system of claim 3, further comprising:

an integral first flange at an end of the sheet moveably attaching the sheet to the pneumatic vacuum elevator cabin through the support member.

5. The pneumatic vacuum elevator guide system of claim 4, further comprising:

an integral second flange at another end of the sheet moveably attaching the sheet to the pneumatic vacuum elevator cabin through the support member such that the first flange and the second flange are disposed at opposite ends of the sheet.

6. An elevator rail guide assembly comprising:

a first rail guide moveably attached to an elevator cabin; wherein the first rail guide comprises a textile material fixedly attached to an external surface of a textile mount wherein the textile mount is formed as a tube;

whereby the tube directly impacts a rail within an elevator thoroughfare through the textile material;

a support member integral with the elevator cabin whereby the first rail guide further comprises a sheet that is movably attached to the support member;

whereby the tube is movably attached to the sheet; and wherein the moveable attachment of the sheet with respect to the support member has distinct degrees of motion relative to the elevator cabin compared to the moveable attachment of the tube with respect to the sheet;

wherein the attachment of the tube to the sheet is through a friction adjuster having selective variable friction force applied to the rail;

wherein the friction adjuster further comprises a fastener adjustably attached to a threaded rivet between the tube and the sheet using a spring; whereby the tube is movably attached to the sheet through an adjustment of the fastener thereby providing selective variable friction force to the rail.

7. The elevator rail guide assembly of claim 6, wherein:

the sheet is a rigid member moveably attached to the elevator cabin and directly attached to the friction rail tightening adjuster such that the rigid member is movably attached to the tube through the friction adjuster.

8. The elevator rail guide assembly of claim 6, wherein:

the sheet comprising a rigid member having a flange such that the rigid member is thereby movably attached to the elevator cabin.

9. The elevator rail guide assembly of claim 8, wherein:

the fastener and the threaded rivet are attached together between the rigid member and the tube through a hole in the rigid member and a corresponding hole in the tube with the spring loaded therebetween.

10. A pneumatic vacuum elevator system comprising:

a pneumatic vacuum elevator cylinder having a cabin inserted therein;

a first adjustable rail guide comprising:

a rigid member moveably attached to the cabin;

a tube that has a textile material attached thereto, such that the tube is adjustably attached with respect to the rigid member using a friction adjuster attached to the rigid member and to the tube; the friction adjuster has selective variable friction applied to a rail;

the first adjustable rail guide is moveably attached with respect to the cabin and in physical contact with the rail attached to the pneumatic vacuum elevator cylinder such that the tube directly contacts the rail through the textile material;

wherein the adjustable attachment of the tube to the rigid member has a different degree of motion relative to the cabin compared to the moveable attachment of the rigid member to the cabin; and wherein the friction adjuster further comprises a fastener and a hole rivet attached together between the rigid member and the textile material mount through a hole in the rigid member and a corresponding hole in the textile material mount with a spring loaded therebetween.

11. The pneumatic vacuum elevator system of claim 10, wherein the rigid member further comprises:

a sheet having an integral flange movably attached to the cabin using the flange.

12. The pneumatic vacuum elevator system of claim 10, wherein:

the textile material mounted on an external surface of the tube directly contacts the rail.

* * * * *